United States Patent [19]

Pike

[11] 4,386,393

[45] May 31, 1983

[54] ADJUSTABLE FRICTIONAL DRAG LAMP SWIVEL

[75] Inventor: Louis D. Pike, Moreland Hills, Ohio

[73] Assignee: Pike Machine Products Company, Cleveland, Ohio

[21] Appl. No.: 199,252

[22] Filed: Oct. 21, 1980

[51] Int. Cl.[3] ..... F21M 3/18

[52] U.S. Cl. ..... 362/427; 362/431; 362/432

[58] Field of Search ..... 362/427, 431, 432

[56] References Cited

U.S. PATENT DOCUMENTS

| | | | |
|---|---|---|---|
| 791,548 | 6/1905 | Fischer . | |
| 1,712,865 | 9/1927 | Allyn . | |
| 2,030,006 | 6/1935 | Kelly . | |
| 2,234,945 | 9/1940 | Baumbach . | |
| 2,365,031 | 3/1942 | Wickens . | |
| 2,395,178 | 2/1946 | Flori | 362/427 |
| 2,488,898 | 11/1949 | Brasty | 362/427 |
| 2,582,159 | 4/1949 | Race . | |
| 4,247,886 | 1/1981 | Warshawsky | 362/427 |

OTHER PUBLICATIONS

Italian Import Swivel hand drawn page.

*Primary Examiner*—Stephen J. Lechert, Jr.

*Attorney, Agent, or Firm*—Fay & Sharpe

[57] ABSTRACT

A swivel with an adjustable frictional drag is disclosed. The swivel has a first member which has a first side wall surrounding a first axial cavity. The first side wall has a generally transverse bore which is connected to a first tubular lamp arm. The first side wall further has an annular engaging surface adjacent one end. A first end wall which has a first axial bore in communication with the first cavity is connected with the other end of the first side wall. A first bearing surface surrounds the first axial bore. The swivel further includes a second member which has a second side wall surrounding a second axial cavity. The second side wall has a generally transverse bore which receives a tubular lamp arm. The second side wall further has a second engaging surface adjacent one end for sliding engagement with the first engaging surface during relative rotational movement between the first and second members. A second end wall which has an axial threaded bore therethrough is connected with the other end of the second side wall. A swivel pin has a head portion at one end which engages the bearing surface of the first end wall and a threaded portion at its other end which engages the axially threaded bore. A set screw is received in the axial threaded bore for abutting the swivel pin to lock it and the axially threaded bore against relative rotation.

15 Claims, 5 Drawing Figures

FIG. 1
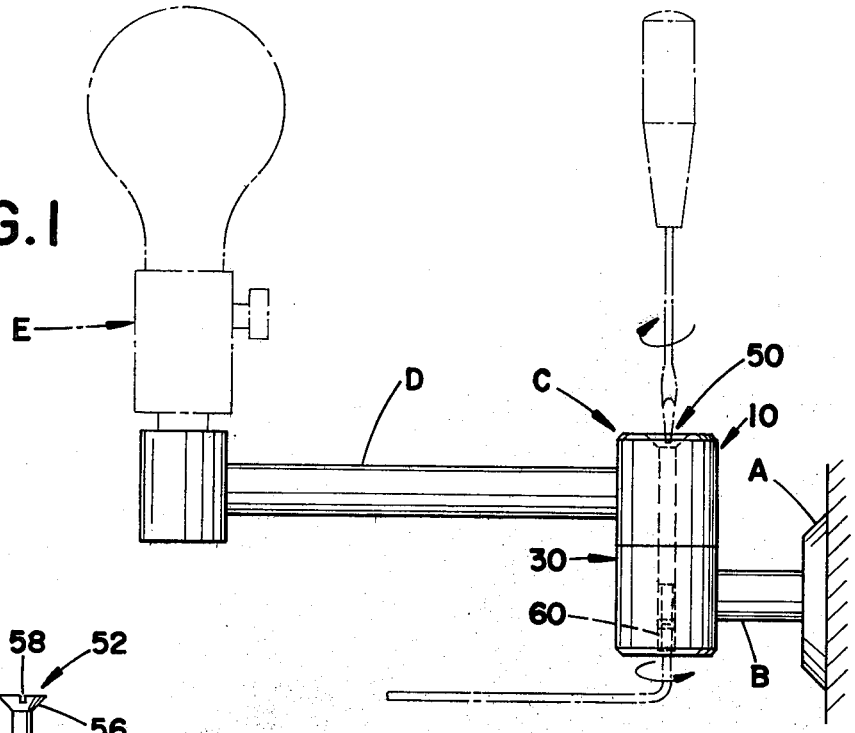
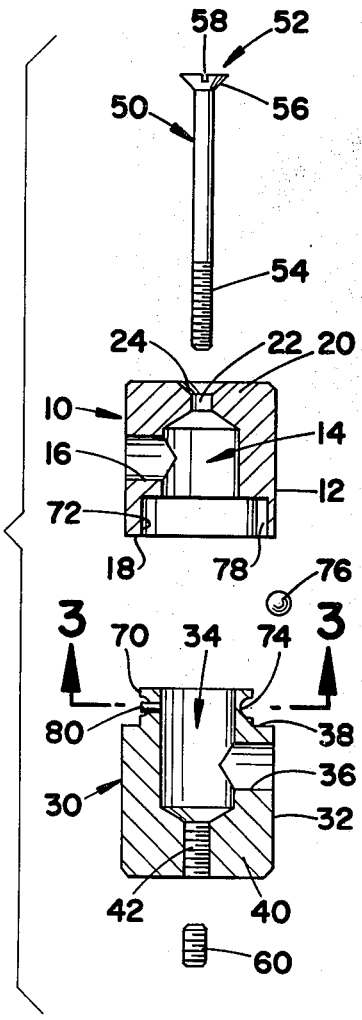
FIG. 2
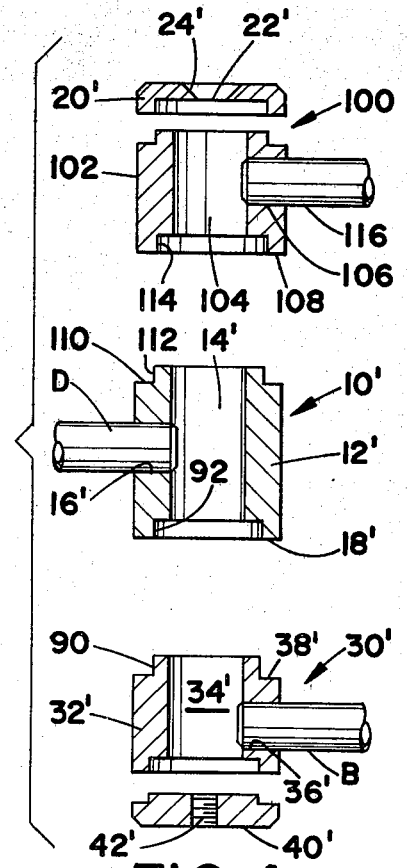
FIG. 4
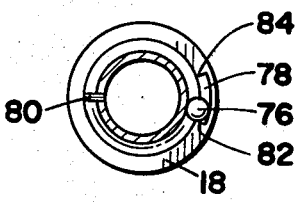
FIG. 3
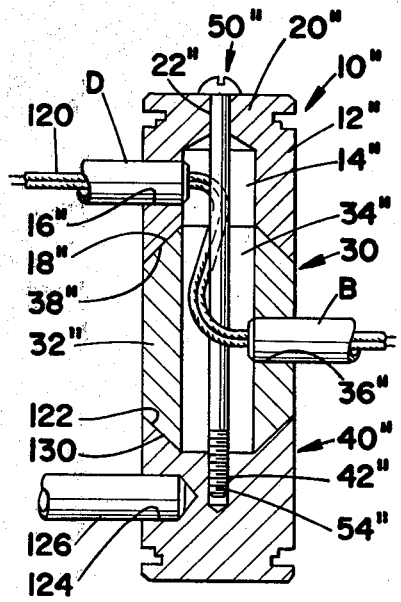
FIG. 5

ADJUSTABLE FRICTIONAL DRAG LAMP SWIVEL

BACKGROUND OF THE INVENTION

This application pertains to the art of pivotal connectors and more particularly to electrical fixture swivels. The invention is particularly applicable to lamp swivels for use in conjunction with swivel lamps and will be described with particular reference thereto. However, it will be appreciated that the invention is applicable to other pivotal connections and joints. The invention may find utility in pivotally connecting fluid carrying pipes or tubes, structural rods or bars, and the like.

Swivels for lamps and other electrical fixtures commonly include a male and a female swivel member. The male and female members have matching engaging surfaces on which they slide as they rotate relative to each other about a central axis. Adjacent its bearing surface, the male member has an extending annular flange. Adjacent its engaging surface, the female member has an annular collar. To connect the male and female members, a press flares the flange of the male member around the collar of the female member. The amount of pressure applied by the press determines the degree of frictional engagement between the engaging surfaces. This, in turn, determines the frictional drag or resistance to relative rotational movement of the male and female members. The male and female members are each connected outward extending arms. One of the arms is commonly connected with a base or mounting unit and the other arm is commonly connected with a fixture for holding a lamp or the like. The swivel allows the position of the lamp to be changed or moved to suit the lighting requirements of the user.

Various problems have been encountered with this type of swivel. One problem is controlling the amount of frictional drag between the male and female members. The amount of frictional drag is determined by the amount of force exerted by the press in the flaring operation. Small tolerances, on the order of a thousandth of an inch, in the flaring operation mark the difference between a swivel which is loose and sloppy and a swivel which is stiff and difficult to turn. It is desirable that swivel lamps require generally the same amount of force to rotate the lamp regardless of the length of the arms. A longer lamp or lever arm tends to decrease the force required to rotate the lamp. Thus, to standardize the force for rotating the lamp, the optimal frictional drag must be varied in accordance with the length of the lamp arm. This commonly necessitates that the swivels and arms be sold in matched sets. Further, the amount of drag tends to be altered in the finishing or plating operation and with use.

Another problem with the prior art swivels resides in the difficulty encountered in threading electrical wires through the arms and the swivel. To prevent damage of the wire, the arms are soldered or braised into the swivel and the flaring operation is performed before the arms and swivel are wired. Once the arms and swivel are assembled, they present a tortuous path along which the wire must be threaded. This renders wiring an arduous and labor intensive operation.

Yet another problem with the prior art swivels is the relatively high plating defect rate. After the swivel members are flared together and the arms are soldered or braised to the swivel, the arms and swivel are commonly plated to improve their esthetic appeal. In the plating operation, the arms and swivel assembly are first cleaned or etched by dipping in an acid solution. Following the acid bath, the assembly is dried and plated. The acid solution tends to become trapped between the engaging surfaces and between the collar and flange of the swivel members. After the assembly has been plated, any trapped acid solution tends to leak out onto the plated surface discoloring or dissolving the plating.

Others have suggested connecting swivel members together with threaded elements. However, when one of the swivel members rotates relative to one of the threaded elements, there is a tendency for the threaded elements to loosen.

The present invention overcomes the above-referenced problems and others yet provides a swivel which is simple and inexpensive to fabricate and install.

SUMMARY OF THE PRESENT INVENTION

In accordance with the present invention, there is provided an improved swivel. The swivel has a first member which has a first side wall accommodating a first axially extending cavity. The first side wall has a first engaging surface adjacent one end and a generally transverse bore which is adapted to receive a tubular arm. The swivel further includes a second member which has a second side wall accommodating a second axially extending cavity. The second side wall has a second engaging surface adjacent one end which is configured for sliding engagement with the first engaging surface during relative rotational movement of the first and second members. The second side wall further has a transverse bore which is adapted to receive a tubular arm. A first end wall which has a first axial bore is operatively connected with the first side wall. A second end wall which has an axially threaded bore is operatively connected with the second end wall. A swivel pin extends through the first axial bore and the first and second cavities. The swivel pin has a head portion at one end and a threaded portion at its other end. The head portion is configured to engage the first end wall and the threaded portion is configured to be received in the threaded bore of the second member. Selective rotation of the swivel pin relative to the threaded bore cams the the first and second engaging surfaces more tightly together which selectively adjusts their degree of frictional engagement. In this manner, the frictional drag between the first and second members is selectively adjusted.

A principal advantage of the present invention is that it allows the frictional drag of the swivel to be selectively adjusted. The the swivel is adjustable to provide the same rotational force with different lengths of arms.

Another advantage of the present invention, is that the swivel members can be assembled by a lamp manufacturer after plating and wiring. This simplifies the wiring procedure and facilitates easier plating or finishing operations.

Other advantages will become readily apparent upon reading and understanding the detailed description.

BRIEF DESCRIPTION OF THE DRAWINGS

The invention may take physical form in certain parts and arrangements of parts, preferred and alternate embodiments of which are described in detail in the specification and illustrated in the drawings. These embodiments are set forth only for purposes of illustrating the invention and are not to be construed as limiting it.

FIG. 1 is a side elevational view of an electrical fixture arm assembly including a swivel in accordance with the present invention;

FIG. 2 is an exploded side sectional view of the swivel of FIG. 1;

FIG. 3 illustrates a section through section line 3—3 of FIG. 2;

FIG. 4 is an exploded side sectional view of an alternate embodiment of a lamp swivel in accordance with the present invention; and FIG. 5 is a side sectional view of yet another alternate embodiment of a lamp swivel in accordance with the present invention.

DESCRIPTION OF THE PREFERRED EMBODIMENTS

FIG. 1 illustrates an electrical fixture assembly of the type commonly denoted as a swivel lamp. The assembly includes a base A which is adapted to be mounted to a vertical wall, to rest on a horizontal surface, or the like. A first tubular arm B is connected between the base A and a swivel C. A second tubular arm D is connected to the swivel C and operatively connected to lamp E or other electrical fixture. The second arm is illustrated connected directly to the lamp E. However, additional swivels and tubular arms may be connected between lamp E and the tubular arm D. The swivel C allows the user to position the lamp E by applying a force to the lamp or tubular arm D to cause rotation about the axis of the swivel.

The swivel of FIG. 1 is illustrated in greater detail in FIG. 2. The swivel C includes a first member 10 which is interconnected with one of tubular arms B and D. The first member 10 includes a generally annular side wall 12 which accommodates a first axially extending cavity 14. A transverse bore 16 extends through the first side wall 12 into the first cavity 14. The transverse bore is most commonly cylindrical but other shapes for receiving tubular arms of various cross sections are contemplated. Optionally, the transverse bore 16 may be threaded for receiving a threaded tubular arm. Adjacent one end of the first side wall 12 is an annular first engaging surface 18.

A first end wall 20 has an axial bore 22 in communication with the first cavity 14. Circumscribing the axial bore 22 is a conical first bearing surface 24. The first end wall 20 is operatively connected with the first side wall 12 to transmit axial forces thereto. In the embodiment of FIG. 2, the first end and side walls are integral and formed from a single piece of metallic bar stock. The first cavity is formed by boring axially into the bar. A circular cross section is preferred, although other cross sections are contemplated by the present invention.

The swivel C further includes a second member 30 which is disposed adjacent the first member 10 for relative rotational movement therebetween. The second member 30 includes an annular second side wall 32 which accommodates an axial, central second cavity 34. The second side wall 32 has an annular bore 36 therethrough into the second cavity 34. The transverse bore 36 is adapted to receive one of the arms B or D. Adjacent one end of the second side wall 32 is an annular second engaging surface 38. The second engaging surface 38 is constructed for slidably engaging the first engaging surface 18. As the first member 10 and second member 30 are rotated relative to each other, there is sliding frictional engagement between the first and second engaging surfaces 18 and 38. The degree or amount of frictional engagement between the first and second engaging surfaces determines the frictional drag or amount of force required to cause the first and second members to undergo relative rotational movement. Optionally, a friction reducing ring may be disposed between the first and second engaging surfaces so that they engage and slide more smoothly. Alternately, a coating of a friction reducing material such as TEFLON or NYLON, may be applied to one or both of the engaging surfaces.

A second end wall 40 is operatively connected with the other end of the second side wall 32 than the second engaging surface 38. The second end wall is connected with an axially threaded bore 42. In the embodiment of FIG. 2, the second end and side walls are integral and the axially threaded bore is tapped directly in the second end wall.

A swivel pin 50 extends through the axial bore 22 in the first end wall 20, the first cavity 14, the second cavity 34, and engages the axial threaded bore 42 of the second end wall 40. The swivel pin has a head portion 52 at one end and a threaded portion 54 at the other end. The head portion includes a second bearing surface 56 which frictionally engages the first bearing surface 24. In the embodiment of FIG. 2, the first and second bearing surfaces are generally conical which assists in maintaining the axial alignment of the swivel pin 50 and the first member 10 and in maintaining the frictional engagement circumferentially around the bearing surfaces substantially constant. Optionally, a friction reducing sleeve or washer may be disposed between the first and second bearing surfaces or a coating applied of friction reducing material, such as TEFLON or NYLON, may be applied to one of the bearing surfaces. The threaded end 54 is threaded into the axial threaded bore 42.

As the swivel pin 50 and the axial threaded bore 42 undergo relative rotation, a camming action between their threads occurs. To adjust the frictional drag of the swivel C, the swivel pin is rotated relative to the axial threaded bore 42. By rotating the swivel pin one direction, the camming action increases the degree of frictional engagement between the first and second bearing surfaces 24 and 56, and between the first and second engaging surfaces 18 and 38. In normal installation, a torque screwdriver shown in phantom in FIG. 1 or other torque indicating tool engages a slot 58 in the swivel pin C. The swivel pin is threaded into the axially threaded bore 42 until a preselected torque is exerted by the screwdriver. The preselected torque is selected on the basis of past experience and the length of tubular arm D. Specifically, the torque is selected to produce the appropriate amount of frictional drag in the swivel such that a desired force on the lamp E is necessary to effect rotation.

Upon adjusting the torque, it will be appreciated that the relative rotational movement between the first bearing surface 24 and the second bearing surface 56 tends to rotate the swivel pin and change the torque or frictional drag adjustment. To lock in the preselected adjustment, a locking means 60 is provided for selectively locking the threaded portion 54 and the axial threaded bore 42 against relative rotation. In the embodiment of FIG. 2, the locking means is a set screw which is threaded axially into the threaded bore 42. By applying a torque to the set screw which is greater than the torque applied to the swivel pin, the swivel pin and the axial threaded bore can be locked against relative rotation. Alternately, other locking means may be used. The locking means may include other mechanical devices such as pins, transverse threaded set screws, locking nuts, deforming the threads, and the like. Further, the locking means may include chemical substances for bonding the swivel pin to the axially threaded bore 42 or for increasing their frictional engagement.

The swivel illustrated in FIGS. 2 and 3 further includes a means for limiting the relative rotational movement between the first and second members 10 and 30. The rotation limiting means including an outward, annular projection 70 on the second member 30 and an annular receiving surface 72 on the first member 10. The outward projection 70 includes an annular race 74 for partially receiving a ball 76. An enlargement 78 adjacent the annular receiving surface 72 also receives part of the ball. A stop pin 80 limits the travel of the ball 76 along the race 74. The first and second members 10 and 30 can rotate from the position in which the stop pin 80 forces the ball 76 against one end 82 of the enlargement 78 around to the position in which the stop pin forces the ball against the outer end 84. By dimensioning the enlargement such that the distance between its ends 82 and 84 is substantially the width of the stop pin 80 plus twice the width of the ball 76, the relative rotational movement of the first and second members can be limited to 360 degrees. This limitation on the rotational movement prevents excessive twisting of the electrical wires.

In the embodiment of FIG. 4, like elements are denoted with the same reference numeral as corresponding elements in FIGS. 1, 2, and 3 followed by a prime (′). A first member 10′ includes an annular first side wall 12′ which surrounds a first axial cavity 14′. The first side wall 12′ has a transverse bore 16′ extending therethrough for receiving tubular arm D. The first side wall has a first bearing surface 18′ at one end.

A second member 30′ has an annular second wall 32′ which surrounds a second, axial cavity 34′. The second side wall 32′ has a transverse bore 36′ for receiving the tubular arm B. At one end of the second member 30′ is a second engaging surface 38′ for engaging the first engaging surface 18′ of the first member 10′. A second end wall 40′ is operatively connected to the other end of the second side wall. An axial threaded bore 42′ extends through the end wall 40′. Adjacent the second engaging surface 38′ is a raised rim 90 which engages an annular recess 92 adjacent the first engaging surface 18′. The annular rim 90 and annular recess 92 maintain the first and second members in axial alignment.

A third member 100 includes an annular third side wall 102 which encompasses a third, axially extending cavity 104. The third side wall 102 has a transverse bore 106 extending therethrough. The third side wall has an annular third engaging surface 108 at one end thereof. The third engaging surface 108 engages an annular fourth engaging surface 110 on the first member 10′. Operatively connected with the outer end of the third annular wall 102 is an end wall 20′. The end wall 20′ has an axial bore 22′ extending therethrough in axial alignment with the axially threaded bore 42′. Around the axial bore 22′ is an annular bearing surface 24′. The first and third members have an annular rim 112 and an annular recess 114 for maintaining axial alignment therebetween. A third tubular arm 116 is connected between the third member 100 and the base A. The three element swivel with two arms connected to the base is commonly denoted as a piano hinge-type swivel. Alternately, the tubular arm from the first section may be connected with the base and the tubular arms from the second and third sections may be connected with the electrical fixture. Such a structure is generally denoted as a double-knuckle swivel.

In the alternate embodiment of FIG. 5, like elements are denoted with the same reference numerals as corresponding elements in the preceding FIGURES followed by a double prime (″). A first member 10″ includes an annular first side wall 12″ which encompasses an axial first cavity 14″. The first cavity has a sufficient diameter to receive a swivel pin 50″ and a continuous length of paired, electrical wire 120. The first side wall 12″ further has a transverse bore 16″ which is connected with the tubular arm D. The first side wall 12″ terminates at one end in an annular first engaging surface 18″ and at its other end is integrally connected with a first end wall 20″. The first end wall 20″ has an axial bore 22″ for receiving the swivel pin 50″.

A second member 30″ includes an annular second side wall 32″ which surrounds an axial second cavity 34″. The second side wall has a transverse bore 36″ for receiving the tubular arm B. The second member has an annular second engaging surface 38″ at one end and another annular engaging surface 122 at its other end. The second cavity 34″ is of sufficient diameter to receive the swivel pin 50″ and the length of paired lamp wire 120.

A second end wall 40″ has an axial threaded bore 42″ for receiving a threaded end 54″ of the swivel pin 50″. The second end wall 40″ includes a transverse bore 124 for receiving a tubular or solid arm 126. The end wall 40″ has an engaging surface 130 for engaging the engaging surface 122 of the second member 30″. The tubular arms D and 126 are connected with the electrical fixture such that the first member 10″ and end wall 40″ are fixedly connected. The first member 10″ and end wall 40″ are disposed for relative rotational movement with respect to the second member 30″. The engaging surfaces 18″, 38″, 122 and 130 are generally conical to hold the first and second members and the second end wall in axial alignment.

The invention has been described with particular reference to the preferred and alternate embodiments. Clearly, modifications and alterations will occur to others upon reading and understanding this specification. It is my intention to include all such modifications and alterations insofar as they come within the scope of the appended claims or the equivalents thereof.

I now claim:

1. In an electrical fixture assembly having a base, a first tubular arm connected with the base and a swivel, a second tubular arm connected with the swivel, the second tubular arm being operatively connected with an electrical fixture, and a continuous length of electrical wire extending from the base, through the first tubular arm, the swivel, and the second tubular arm, to the electrical fixture; the swivel comprising:

a first member having a first side wall which accommodates a first axially extending cavity, the first member having a first engaging surface adjacent one end and a first end wall at an opposite end, the first side wall defining a first transverse bore therethrough, the first end wall defining a first axial bore which has a first bearing surface disposed therearound;

a second member having a second side wall which accommodates a second axially extending cavity, the second member having a second engaging surface adjacent one end which slidingly engages the first engaging surface to permit relative rotational movement between the first and second members and having a second end wall at an opposite end, the second side wall having a second transverse bore therethrough, the second end wall defining an axially threaded bore;

a swivel pin extending through the first axial bore and the first and second cavities, the swivel pin having a head portion at one end with a second bearing surface for engaging the first bearing surface and a threaded portion at its other end for being received in the axially threaded bore, such that selective relative rotation between the swivel pin and the axially threaded bore causes a camming action which selectively adjusts the degree of frictional engagement between the first and second engaging surfaces and the first and second bearing surfaces;

the first and second tubular arms each being connected with one of the first and second transverse bores, whereby the wire passes through the first and second transverse bores and the first and second cavities of the swivel.

2. The assembly as set forth in claim 1 wherein the first and second bearing surfaces are generally conical.

3. The assembly as set forth in claim 1 wherein the swivel further includes a locking means for selectively locking the threaded portion of the swivel pin and the axially threaded bore against relative rotation whereby the selectively adjusted frictional engagement is selectively locked.

4. A swivel with adjustable frictional drag comprising:

a first member having a first side wall accommodating a first cavity, the first side wall having a generally transverse bore which is adapted to receive a tubular arm, the first side wall having an annular first engaging surface adjacent one end;

a first end wall having a first axial bore in communication with the first cavity and a first conical bearing surface surrounding the first axial bore, the first end wall being operatively connected with the first side wall for transmitting axial forces thereto;

a second member having a second side wall accommodating a second cavity, the second side wall having a generally transverse bore which is adapted to receive a tubular arm and having an annular second engaging surface adjacent one end, the second engaging surface configured for sliding engagement with the first engaging surface during relative rotational movement between the first and second members;

a second end wall having an axial threaded bore connected therewith, the second end wall being operatively connected with the second side wall for transmitting axial forces thereto;

a swivel pin having an enlarged head portion with a second conical bearing surface at one end for engaging the first conical bearing surface and a threaded portion at its other end for being received in the axial threaded bore of the second end wall, such that selective relative rotation between the swivel pin and the axial threaded bore selectively adjusts the frictional engagement between the first and second engaging surfaces and the first and second conical bearing surfaces, whereby frictional drag between the first and second members when rotated relative to each other is selectively adjusted; and locking means for selectively locking the threaded portion of the swivel pin and the axially threaded bore against relative rotation, whereby the locking means selectively locks the adjusted frictional drag.

5. The swivel as set forth in claim 4 wherein the axial threaded bore extends through the second end wall and the locking means includes a threaded member which is received in the axial threaded bore.

6. The swivel as set forth in claim 4 wherein the second end wall and the second side wall are integral.

7. The swivel as set forth in claim 6 wherein the first end wall and the first side wall are integral.

8. The swivel as set forth in claim 4 further including means for limiting the amount of relative rotational movement between the first and second members.

9. The swivel as set forth in claim 8 wherein the limiting means limits the amount of relative rotational movement to substantially 360 degrees.

10. In an electrical fixture assembly having a base, a first tubular arm connected with the base, a second tubular arm being operatively connected with an electrical fixture, a swivel connected with the first and tubular arms, and a continuous length of electrical wire extending from the base through the first tubular arm, the swivel, and the second tubular arm, to the electrical fixture; the swivel comprising:

a first hollow member having a first tubular side wall which accommodates a first axially extending cavity, the first tubular side wall defining a first annular engaging surface extending peripherally adjacent one end, the first tubular side wall defining a first transverse bore therethrough in which one of the first and second arms is received;

a first end wall operatively connected with the other end of the first tubular side wall, the first end wall defining a first axial bore centrally therethrough and having a first bearing surface around the first axial bore;

a second hollow member having a second tubular side wall which accommodates a second axially extending cavity, the second side wall defining a second annular engaging surface peripherally adjacent one end, the second annular engaging surface slidably engaging the first annular engaging surface to permit relative rotational movement between the first and second members, the second side wall having a second transverse bore therethrough in which the other of the first and second tubular arms;

a second end wall operatively connected with the other end of the second end wall, the second end wall having an axial threaded bore centrally connected therewith;

a swivel pin extending through the first axial bore, the first axial cavity, the second axial cavity, and into the axial threaded bore, the swivel pin having a head portion including a second bearing surface at one end, the second bearing surface engaging the first bearing surface in a rotationally sliding engagement therewith, the swivel pin further having a threaded portion at its other end which is received in the axially threaded bore, such that selective relative rotation between the swivel pin and the axial threaded bore adjusts the degree of frictional engagement between the first and second bearing surfaces and the degree of frictional engagement between the first and second annular engaging surfaces; and, locking means for selectively locking the threaded portion of the swivel pin and the axial threaded bore against relative rotation, whereby the selectively adjusted frictional engagement is fixed.

11. The assembly as set forth in claim 10 wherein one of the first and second members includes an annular projection disposed adjacent its bearing surface and the other of the first and second members include an annular receiving surface adjacent its bearing surface for receiving the annular projection, the annular projection and receiving surface maintaining the first and second members in axial alignment during rotation.

12. The assembly as set forth in claim 11 wherein the annular projection includes an outward facing race extending peripherally therearound and a stop element disposed in the race, wherein the annular receiving surface includes an enlargement disposed adjacent the race, and further including a ball received between the race and the enlargement.

13. The assembly as set forth in claim 2 wherein the enlargement has a peripheral length which is generally the same as the sum of the circumferential lengths of the stop element and the ball such that the first and second members are limited to generally 360° of relative rotational movement.

14. The assembly as set forth in claim 10 further including a third tubular arm with one end connected to the swivel and with the other end operatively connected with one of the base and the electrical fixture, and wherein the swivel further includes a third side wall having a transverse bore which receives the third tubular arm, the third side wall having a third engaging surface at one end for engaging a fourth engaging surface disposed on one of the first and second members and being connected at the other end with one of the first and second end walls.

15. The assembly as set forth in claim 3 wherein the first side wall is integral with the first end wall and wherein the second side wall is integral with the second end wall.

* * * * *